US011060679B2

(12) United States Patent
Mittelberger

(10) Patent No.: US 11,060,679 B2
(45) Date of Patent: Jul. 13, 2021

(54) DISCO BALL

(71) Applicant: Rafael Mittelberger, Hamburg (DE)

(72) Inventor: Rafael Mittelberger, Hamburg (DE)

( * ) Notice: Subject to any disclaimer, the term of this patent is extended or adjusted under 35 U.S.C. 154(b) by 268 days.

(21) Appl. No.: 15/632,855

(22) Filed: Jun. 26, 2017

(65) Prior Publication Data

US 2017/0370542 A1 Dec. 28, 2017

(30) Foreign Application Priority Data

Jun. 27, 2016 (DE) ..... 10 2016 111 760.9

(51) Int. Cl.

| | |
|---|---|
| ***F21S 10/06*** | (2006.01) |
| ***F21V 7/10*** | (2006.01) |
| ***A63H 27/10*** | (2006.01) |
| ***A63B 41/10*** | (2006.01) |
| ***F21V 14/04*** | (2006.01) |
| ***A63H 33/22*** | (2006.01) |
| ***G09F 19/16*** | (2006.01) |
| ***A63J 99/00*** | (2009.01) |
| ***A63B 43/06*** | (2006.01) |

(52) U.S. Cl.

CPC ..... *F21S 10/063* (2013.01); *A63B 41/10* (2013.01); *A63B 43/06* (2013.01); *A63H 27/10* (2013.01); *A63J 99/00* (2013.01); *F21V 7/10* (2013.01); *F21V 14/04* (2013.01); *A63H 33/22* (2013.01); *G09F 19/16* (2013.01)

(58) Field of Classification Search

CPC ..... A63B 41/10; A63B 43/06; A63H 27/10; A63H 33/22; A63J 99/00; F21S 10/063; F21V 14/04; F21V 7/10; G09F 19/16

See application file for complete search history.

(56) References Cited

U.S. PATENT DOCUMENTS

| | | | | |
|---|---|---|---|---|
| 1,383,115 A * | 6/1921 | Hendry | G09B 27/08 434/138 |
| 2,579,646 A * | 12/1951 | Branson | B21D 51/24 228/155 |
| 3,162,377 A * | 12/1964 | Ozeki | F21V 1/06 362/320 |
| 5,605,396 A * | 2/1997 | Chin, Jr. | F21V 1/06 312/140 |
| 6,305,827 B1 * | 10/2001 | Nolle | F21L 14/00 362/189 |

(Continued)

OTHER PUBLICATIONS

Inflatable Fabric Structure: The World's Largest Disco Ball—Architen Landrell ; Photo credits: Bestival 2014 Twitter Feed (Year: 2014).*

(Continued)

*Primary Examiner* — Tsion Tumebo

(74) *Attorney, Agent, or Firm* — Bay State IP, LLC

(57) ABSTRACT

A disco ball with an outer skin (3) which on the outside is fitted with mirror pieces (6) and has an expandable inner structure (2) comprising an inflatable inner skin which in expanded state is spherical and holds the outer skin (3) in a ball shape, characterized in that the outer skin (3) has a plurality of approximately lenticular segments (4) which are arranged next to each other, and adjacent lenticular segments (4) are releasably connected together to form the outer skin (3), and the lenticular segments (4) are each fitted with mirror pieces (6) on the outside.

7 Claims, 6 Drawing Sheets

(56) References Cited

U.S. PATENT DOCUMENTS 6,474,843 B2 * 11/2002 Shieh ..... B44C 5/00 362/227
6,712,488 B2 * 3/2004 Lee ..... H01J 65/044 315/85
7,192,329 B2 * 3/2007 Lee ..... A63H 33/04 428/34.1
7,308,768 B2 * 12/2007 Rice ..... G09F 19/12 362/293
D605,552 S * 12/2009 van der Lande ..... D11/141
8,210,973 B2 * 7/2012 Rapaport ..... B32B 27/40 473/604
8,672,496 B2 * 3/2014 O'Kane ..... G09F 19/16 362/35
9,314,706 B1 * 4/2016 Wicken ..... A63H 27/10
9,623,289 B2 * 4/2017 McNamee ..... B29D 22/02
D867,921 S * 11/2019 Inoko ..... D11/121
2007/0123140 A1 * 5/2007 Bonsembiante ..... A63H 27/10 446/220
2008/0032589 A1 * 2/2008 Sun ..... A63H 27/10 446/220
2008/0188333 A1 * 8/2008 Tsai ..... A63B 41/02 473/604
2009/0141491 A1 * 6/2009 Chu ..... G09F 21/06 362/231
2010/0014292 A1 * 1/2010 Dellian ..... F21V 1/06 362/278
2010/0142209 A1 * 6/2010 Cuppett ..... F21V 1/06 362/311.08
2010/0248873 A1 * 9/2010 Cooper ..... A63B 41/08 473/599
2011/0162637 A1 * 7/2011 Hahn ..... F24S 23/79 126/600
2012/0020076 A1 * 1/2012 Leung ..... F21V 3/026 362/235
2013/0107520 A1 * 5/2013 O'Kane ..... G09F 19/16 362/235

OTHER PUBLICATIONS

Anonymous; https://www.alibaba.com/product-detail/2019-giant-PVC-inflatable-disco-ball_60359865155.html?spm=a2700.7724857.main07.40.4cde024215c8Lv (Online shopping portal showing PVC Inflatable Mirror Disco Ball for sale by Guangzhou Hao Yi Inflatable Co. Ltd.).

Architen Landrell; http://www.architen.com/projects/inflatable-fabric-structure-disco- ball/; Inflatable Fabric Structure: The World's Largest Disco Ball; From Bestival music festival, Sep. 6, 2014 (Web article discussing disco ball at "Bestival" music festival held on the Isle of Wight in Sep. 2014).

* cited by examiner

DISCO BALL

CROSS-REFERENCE TO RELATED PATENT APPLICATIONS

To the fullest extent permitted by law, this nonprovisional utility patent application claims priority under 35 U.S.C. § 119 to Germany Patent Application No. 10 2016 111 760.9, with a filing date of Jun. 27, 2016.

FIELD OF THE INVENTION

The invention concerns a disco ball with an outer skin fitted on the outside with mirror pieces. The invention also concerns a method for assembling a disco ball.

BACKGROUND OF THE INVENTION

Disco balls are naturally known in the prior art. Disco balls usually have an inner polystyrene ball which on the outside is fitted with mirror pieces; the mirror pieces are glued onto the outside of the polystyrene ball. In addition, the disco ball has suspension devices which allow the disco ball to be securely suspended from the ceiling, a supporting structure or similar.

The problem with disco balls is that there is an increasing demand for very large disco balls which may be several meters in diameter. Firstly, disco balls with a diameter of 3 to 4 meters, as currently used, can only be transported on conventional roads with special safety precautions, and secondly large disco balls have a substantial weight of several hundred kilograms, in some cases several tons.

Inflatable disco balls are known in the prior art. At the "Bestival" in Robin Hill Country Park on the Isle of Wight in September 2014, a disco ball was publicly revealed which has a diameter of 10.33 m, and comprises an inner skin of PVC which is inflatable and an outer skin comprising a net surrounding the inner skin.

BRIEF SUMMARY OF THE INVENTION

It is therefore an object of the present invention to provide a disco ball which, despite its size, is easy to transport and also has a low weight.

This object is achieved with regard to the device by a disco ball with the features of claim 1.

The invention utilizes the concept of providing a disco ball with an expandable inner structure which is in collapsed state during transport and has a low volume and can therefore be transported very easily, while it expands for use at events and can be suspended above an event area while having a diameter of several meters and optically, viewed from the outside, shows no difference from a conventional polystyrene disco ball.

The invention in particular makes use of the astonishingly simple idea of providing an inflatable disco ball which is in a slack state during transport and has a low volume and can therefore be transported very easily, whereas it is inflated for use at events.

The outer skin is laid externally around the inner structure. It may lie on the inner skin over a large surface.

According to the invention, the outer skin has a plurality of approximately lenticular segments arranged next to each other, and adjacent lenticular segments are connected together to form the outer skin. The lenticular segments are connected together in such a manner that they can be released or separated again. This allows the outer skin to be transported not in one piece but in several segments, and the segments only assembled to form the outer skin at the event site.

The disco ball according to the invention has an inflatable inner skin which in the inflated state is spherical and holds the outer skin in a ball shape. The invention uses the surprisingly simple idea of providing a conventional inner skin which consists of a flexible plastic and is substantially air-impermeable, preferably fully air-impermeable, and surrounding this soft inner skin with an outer skin, wherein the outer skin is preferably provided with the known mirror pieces of a disco ball. Inflating the inner skin at the same time brings the outer skin to a spherical form.

It has proved particularly advantageous to use lenticular segments, wherein preferably sixteen but a higher or also a lower number of segments may be used.

The segments run along the outer skin from the north to the south pole, are formed tapering towards the north and south poles, and at the equator of the disco ball the segments have their greatest width. The lenticular segments are fitted with mirror pieces on the outside, the mirror pieces may all be configured identically but may also have different outer forms; favorably, the mirror pieces are glued onto the outsides of the segments and cover the outsides of segments substantially completely, preferably completely. Preferably, all outsides are covered with mirror pieces. The mirror pieces are adapted to the edges of the segments, preferably to the contour of the segments, i.e. they deviate from the shape of the mirror pieces which are used along the remaining inner face of the segments. The mirror pieces may all be identical in structure and they are preferably quadratic; they may however have different forms, and may in particular also be formed rectangular, circular, hexagonal etc. The shapes of the mirror pieces may also be mixed.

In addition, the mirrors may be designed with a color. All mirrors may have the same color or they may have different colors.

Favorably, Velcro® tape is provided on the inside on the longitudinal edges of each of the lenticular segments, and a complementary piece of Velcro® tape is joined on the inside above the Velcro® tape of adjacent lenticular segments.

The lenticular segments are preferably stacked in a box during transport. After transport, they are removed from the box, placed next to each other and preferably the Velcro® tapes along the edges of the lenticular segments are connected to the complementary Velcro® tape. Alternatively, it is also conceivable that the lenticular elements are applied directly onto the inner ball and attached there for example by means of Velcro® tape.

It is however also conceivable to connect the lenticular segments together in a different fashion, such as by button-like connections, by clamp connections of similar.

In a particularly preferred embodiment of the invention, a ring is provided at a north pole to which the tips of each lenticular segment are attached, and the ring has suspension devices from which cables depart for suspension of the disco ball. The lenticular segments, because of the mirror pieces applied thereto, may have substantial weight of many kilograms, in some cases up to 100 kilograms per segment. To secure the segments, the tips of each lenticular segment are attached to the ring, preferably a metal ring. For this, the metal ring may have holes or bores. The lenticular segments may also have holes, and bolts are guided through the holes with which the tips of the segments may be attached to the holes of the ring.

The entire disco ball is also suspended with its weight on the ring. For this, further suspension devices are provided on the ring in the form of holes, eyelets or similar which can support a corresponding weight.

Preferably, a compressor or fan is arranged at the north pole and is connected to the inner skin via an intake air shaft. It has been found that inner skins consisting of plastic, such as polyurethane, polyethylene or similar, lose air over time or change their volume because of temperature fluctuations in the room. To compensate for this volume change or air loss, a compressor is provided via which ambient air can be blown into the inner skin via a supply air shaft.

Furthermore, an overflow valve is provided which automatically allows air to be released if the internal pressure of the inner skin becomes too high.

The object is achieved in its second aspect by a method, in that an outer skin is provided which has mirror pieces applied to the outside, and an expandable inner structure is inserted in the outer skin.

According to the invention, an inflatable inner skin is used as an inner structure. The inner skin is inserted in the outer skin, it is then inflated and thus the outer skin is expanded into a ball shape.

The invention makes use of the very simple but very effective idea of bringing very bulky disco balls into a small form for transport, preferably in that the disco ball can be inflated or its air released. During transport, the disco ball is in a slack and dismantled state; during use at an event however, the disco ball is inflated and suspended over an event area. Preferably ambient air is used for inflation. However, other gases may also be used.

According to the invention, identical lenticular segments are provided which are arranged next to each other, connected at their outer edges, and form a slack outer skin. The lenticular segments have already been described above.

The method described is particularly suitable for assembling one of the disco balls described above.

Favorably, each of the lenticular segments is attached to the ring by a tip, and the disco ball is suspended from a ceiling via suspension devices of the ring. Segments may be firmly secured by means of bolts or other closures to a stable ring, preferably a metal or steel ring, and assembled. The applicable safety regulations should be observed.

In a refinement of the invention, the disco ball is equipped with a compressor, the compressor is connected to the inner skin air-conductively and, on pressure fluctuations of the inner skin, can adjust the internal air pressure by the supply or outlet of air.

After use, the outer skin may be removed again and the inner structure shrunk, either by dismantling the inner rod linkage or evacuating the air from the inner skin.

BRIEF DESCRIPTION OF THE SEVERAL VIEWS OF THE DRAWINGS

The invention is described in six figures with reference to an exemplary embodiment. The drawings show.

DETAILED DESCRIPTION OF THE INVENTION

Figure 1:
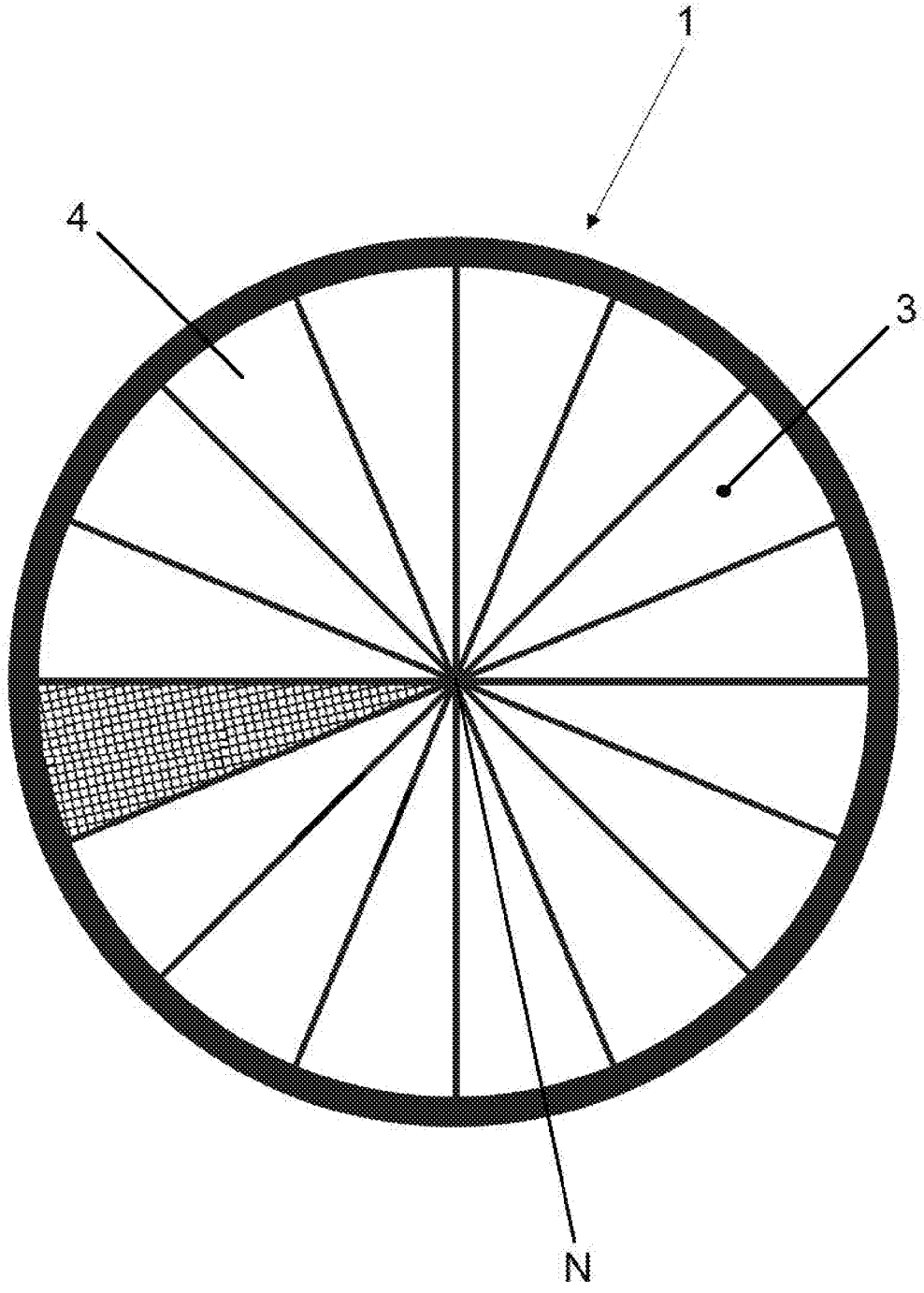
FIG. 1 a top view of the disco ball according to the invention.

A disco ball 1 according to the invention has an inner skin 2 and an outer skin 3; FIG. 1 shows only the outer skin 3 viewed onto a north pole N of the disco ball 1. The outer skin 3 comprises sixteen lenticular segments 4.

A different number of segments 4 is also conceivable, in particular more but also fewer segments 4 may be used to form the outer skin 3.

The segments 4 are preferably lenticular, they may also have different outer forms. The segments 4 of a disco ball 1 are preferably exactly the same. However, deviations in design and form of the segments 4 of the disco ball 1 are conceivable, in particular the segments 4 may have different widths at an equator of the disco ball 1.

Figure 2:
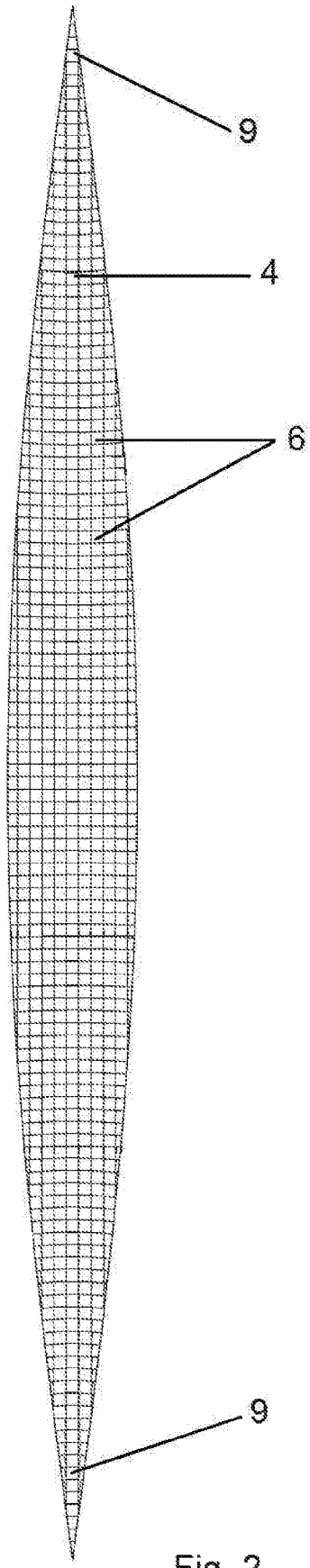
FIG. 2 a top view of a lenticular segment of the disco ball in FIG. 1.

One of the segments 4 shown in FIG. 1 is depicted in FIG. 2 in plan view and in top view. The segment 4 is expanded flat in FIG. 2, while the segments 4 in FIG. 1 are arranged curved in a semicircle to form the outer skin 3 and are also connected together in this way.

The lenticular segments 4 have mirror pieces 6 at their outer face, covering the outer face completely. The mirror pieces 6 are formed largely quadratic in their outer shape in FIG. 2, and are glued directly next to each other onto the outside of the lenticular segment 4. However, other forms of fixing are conceivable. A reflective surface of the mirror pieces 6 faces outward.

Other forms, in particular of the outer periphery of the mirror pieces 6, may be used. In particular, they may be circular, triangular, hexagonal or have other shapes. The mirror pieces 6 of a disco ball 1 may also have mutually differing forms. Preferably however, the outside of the lenticular segments 4 is completely covered by the mirror pieces 6.

Figure 3:
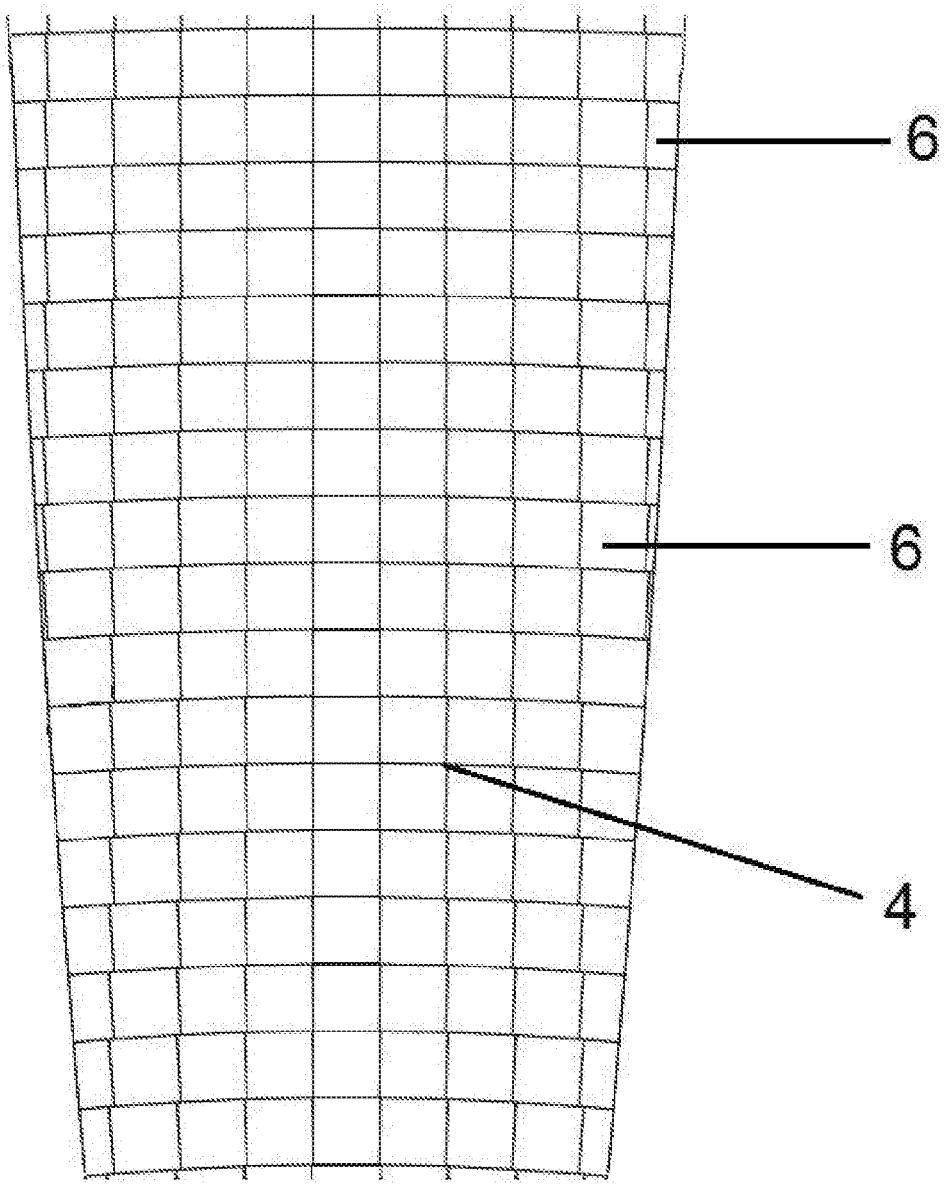
FIG. 3 a view of a detail of FIG. 2.

FIG. 3 shows a design of the lenticular segment 4 with quadratic mirror pieces 6. The mirror pieces 6 at the edge of the lenticular segment 4 are adapted to the contour of the lenticular shape. Alternatively, it is also possible to retain the shape of the mirror pieces 6 over preferably each of the segments 4, and vary the distances between the mirror pieces 6 and thus achieve an even distribution.

Figure 4:
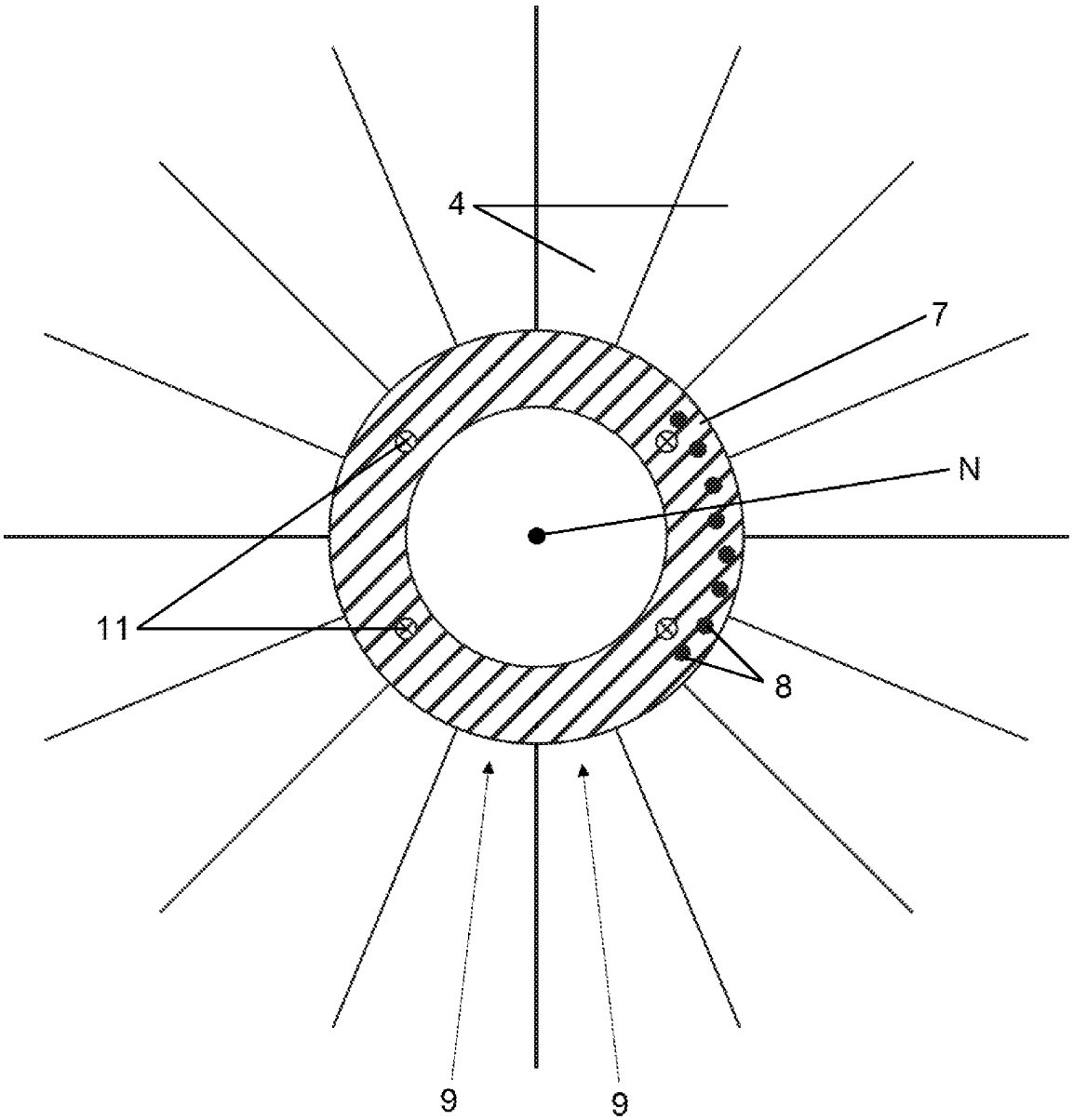
FIG. 4 a diagrammatic view of the disco ball, showing the north pole with inner and outer skin and air inlet.

FIG. 4 shows an embodiment of the north pole N of the disco ball 1 as used, in order to suspend the disco ball 1 from a supporting structure such as a ceiling, a metal frame or similar. The north pole N is surrounded by a terminating ring 7 which is preferably made of metal. The terminating ring 7 firstly has bores 8 assigned in pairs to a tip 9 of a lenticular segment 4. The lenticular segment 4 also has holes at the same distance apart as the pair of bores 8 of the terminating ring 7. A bolt is passed through each pair of a hole and bore 8 from inside to outside in order to fix each of the lenticular segments 4 firmly and securely to the terminating ring 7. The terminating ring 7 has bores 8 on the periphery, preferably spaced equidistantly; in FIG. 4 therefore, thirty-two bores 8 would be provided for the sixteen lenticular segments 4.

In addition, suspension devices 11 are provided on the terminating ring 7, which may also be holes, but also eyelets or similar, through which cables or other suspension means can be drawn in order to suspend the disco ball 1 with its entire weight from a ceiling, supporting structure or similar. Disco balls 1 may have substantial weight; with a diameter of 4 to 5 meters, because of the high number of mirror pieces 6, the weight of the disco ball 1 may amount to several hundred kilograms. The suspension devices 11 and the terminating ring 7 must therefore have a corresponding load-bearing capacity to comply with the necessary safety regulations.

The lenticular segments 4 are also connected together on an inside. This may be achieved by various connecting methods, in particular a Velcro® tape may be placed along each edge on the inside of the lenticular segments 4, and the Velcro® tapes may be joined to a complementary Velcro® tape so as to create cohesive outer skin 3 which covers the Velcro® tapes.

Figure 5:
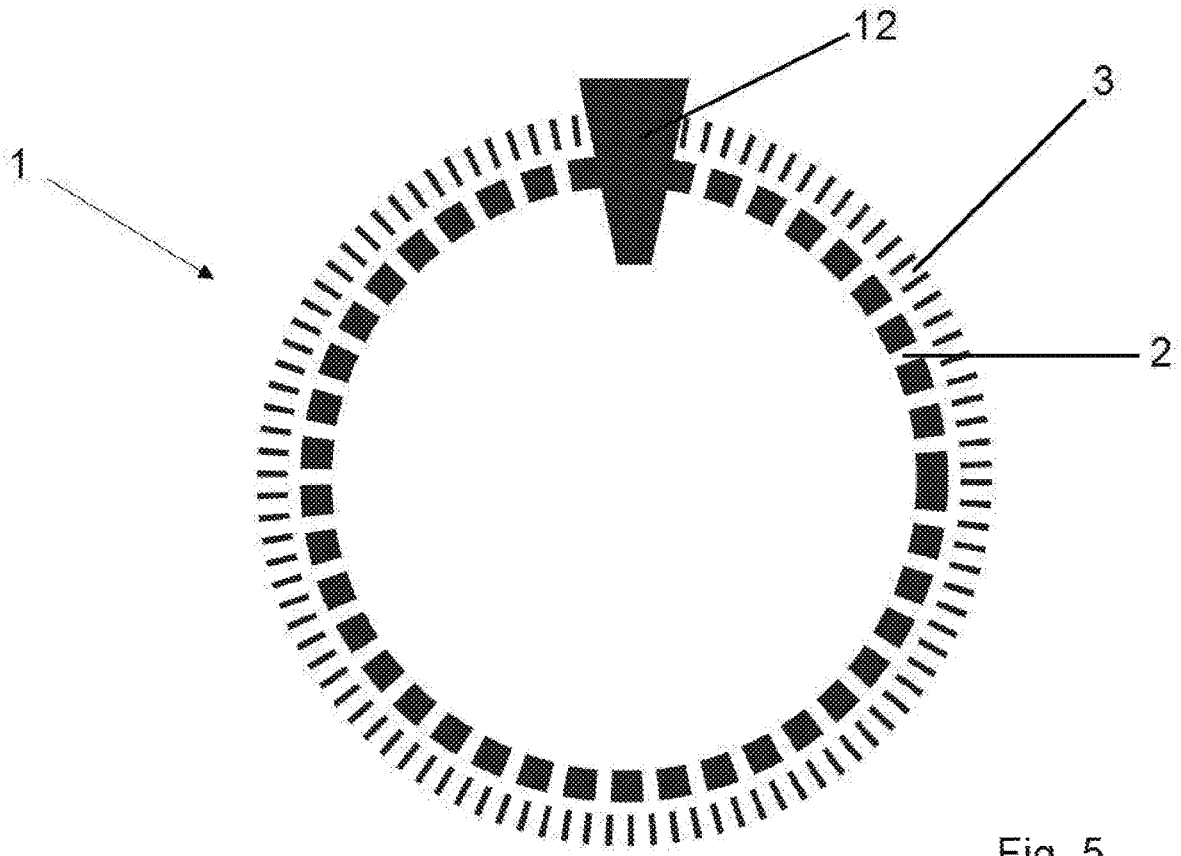
FIG. 5 a disco ball in a diagrammatic cross-sectional view.

It is however also conceivable that the lenticular segments 4 may be joined together by clamp connections, button-like connections or similar. The outer skin 3 is slack and brought into a ball shape by the inflatable inner skin 2. FIG. 5 shows diagrammatically the inflated disco ball 1 according to the invention with the inflated inner skin 2. The inner skin 2 consists of a plastic, for example polyurethane or similar; in each case it is a flexible plastic which forms a normally slack inner skin 2, and in inflated state assumes a spherical shape and has a stability such that the inner skin 2 presses the outer skin 3 into a ball shape despite the substantial weight of the outer skin 3.

The inner skin 2 has an air inlet 12 and an air outlet which can both be closed. Additional securing cables may be provided on the inside of the outer skin 3 which join the segments 4 together and also prevent a sagging of the segments 4 when the air is let out of the inner skin.

Figure 6:
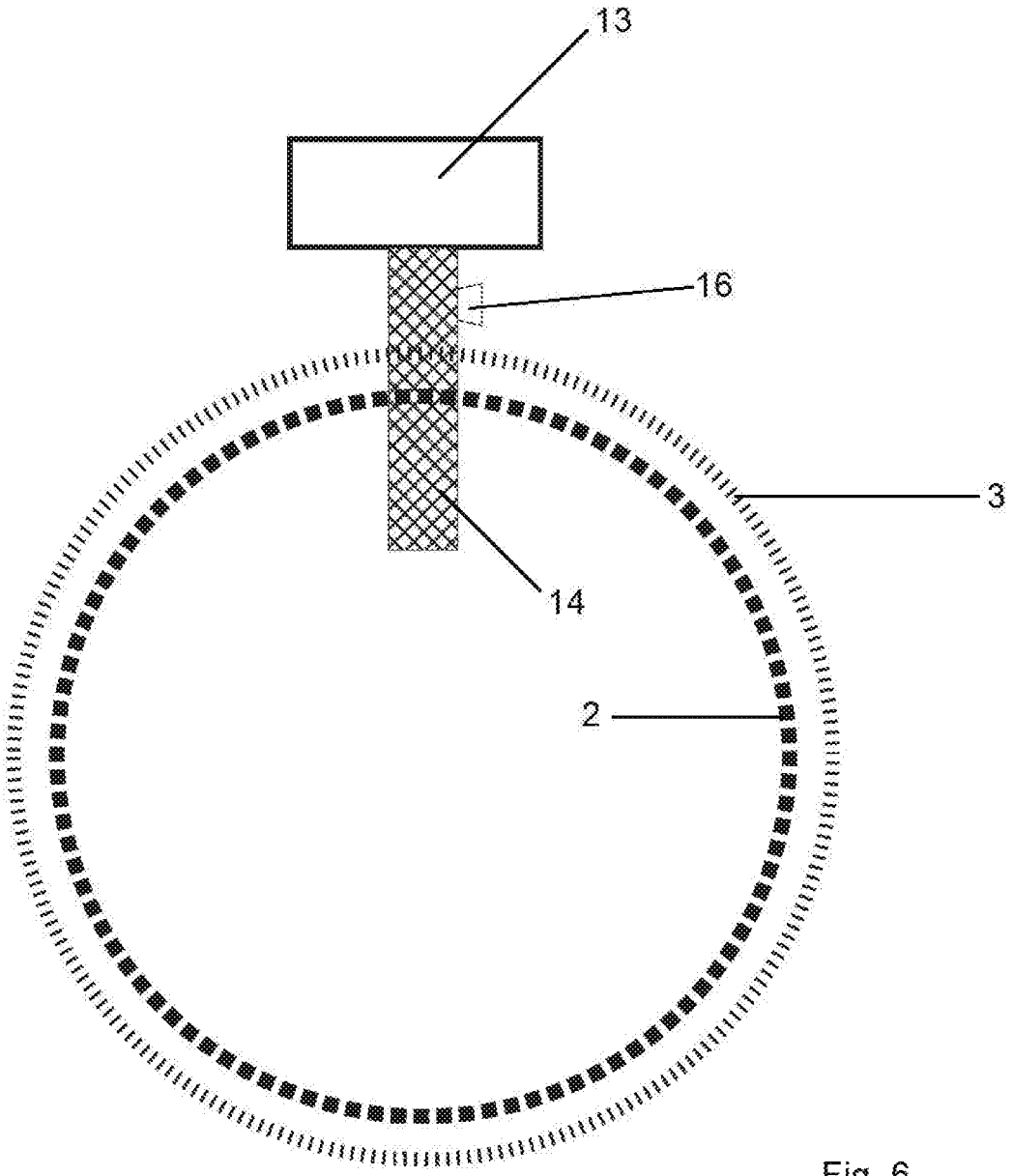
FIG. 6 a disco ball in FIG. 4 with a compressor introduced into the air inlet.

Since the inflatable disco ball 1 is normally used for several hours or even days, and for events must be suspended above an event site for several hours inflated as firmly as possible, according to FIG. 6, instead of an air inlet 12, a compressor 13 with a supply air shaft 14 may be used, which constantly refills the inner skin 2 to compensate for escaping air. The supply air shaft 14 may be provided with an overpressure valve 16 to prevent the inner skin 2 from bursting due to overpressure.

LIST OF REFERENCE NUMERALS

1 Disco ball
2 Inner structure/inner skin
3 Outer skin
4 Segment
6 Mirror piece
7 Terminating ring
8 Bore
9 Tip
11 Suspension device
12 Air inlet
13 Compressor
14 Supply air shaft
16 Overpressure valve
N North pole

What is claimed is:

1. A disco ball with an outer skin (3) which on the outside is fitted with mirror pieces (6) and has an expandable inner structure (2) comprising an inflatable inner skin which in expanded state is spherical and holds the outer skin (3) in a ball shape, and with a north pole (N), a south pole and an equator, characterized in that the outer skin (3) has a plurality of approximately lenticular segments (4) which run along the outer skin approximately from the north pole to the south pole, whereby the lenticular segments (4) are formed tapering towards the north pole, and the south pole, and have their greatest width at the equator, the approximately lenticular segments (4) are arranged next to each other, and adjacent lenticular segments (4) are releasably connected by a Velcro® tape or button-like connections or clamp connections together to form the outer skin (3), and the lenticular segments (4) are each fitted with mirror pieces (6) on the outside and it can be inflated and suspended over an event area or it can be dismantled into the lenticular segments for transport; and characterized in that a Velcro® tape is provided on longitudinal edges on the inside of each of the lenticular segments (4), and a complementary Velcro® tape is joined on the inside over Velcro® tapes of the adjacent lenticular segments (4).

2. The disco ball according to claim 1, characterized in that the inner structure comprises an inner rod linkage with struts which can be connected together releasably.

3. The disco ball according to claim 1, characterized in that at a north pole (N), a ring (7) is provided on which tips (9) of each lenticular segment (4) are attached, and the ring (7) has suspension devices (11) from which cables depart for suspension of the disco ball (1).

4. The disco ball according to claim 1, characterized by a compressor (13) which is arranged at a north pole (N) and is connected to the inner skin via a supply air shaft (14).

5. A method for assembly of a disco ball with a north pole (N), a south pole and an equator comprising: dismantled lenticular segments (4) being transported to an event area and being connected together at their edges and arranged next to each other and form a slack outer skin (3) with mirror pieces (6) applied on the outside, running along the outer skin from the north pole to the south pole, whereby the lenticular segments (4) are formed tapering towards the north pole and the south pole, and have their greatest width at the equator and an inflatable inner structure (2) being inserted into the outer skin (3), the inner skin (2) being expanded and thus the outer skin (3) is expanded into a ball shape and characterized in that a Velcro® tape is provided on longitudinal edges on the inside of each of the lenticular segments (4), and a complementary Velcro® tape is joined on the inside over Velcro® tapes of the adjacent lenticular segments (4).

6. The method according to claim 5, characterized in that each of the lenticular segments (4) is attached to a ring (7) by a tip (9), and the disco ball (1) is suspended from a ceiling via suspension devices (11) of the ring (7).

7. The method according to claim 5, characterized in that the inner skin (2) is constantly refilled with air by means of a compressor (13) in order to maintain a constant interior pressure.

* * * * *